US011304868B1

(12) United States Patent
Gainza

(10) Patent No.: US 11,304,868 B1
(45) Date of Patent: Apr. 19, 2022

(54) PROTECTIVE PATIENT PROCEDURE CHAIR/TABLE TOE PROTECTIVE COVER WITH IMPROVED HYGIENIC AND ADAPTABLE DESIGN FOR MEDICAL TREATMENT FURNISHINGS

(71) Applicant: Marta Gainza, Miami, FL (US)

(72) Inventor: Marta Gainza, Miami, FL (US)

( * ) Notice: Subject to any disclaimer, the term of this patent is extended or adjusted under 35 U.S.C. 154(b) by 0 days.

(21) Appl. No.: 16/949,940

(22) Filed: Nov. 20, 2020

Related U.S. Application Data

(60) Provisional application No. 62/939,230, filed on Nov. 22, 2019.

(51) Int. Cl.

| | |
|---|---|
| ***A47C 31/11*** | (2006.01) |
| ***A61G 15/10*** | (2006.01) |
| ***A47C 31/02*** | (2006.01) |
| ***A47C 31/00*** | (2006.01) |

(52) U.S. Cl.
CPC ..... *A61G 15/10* (2013.01); *A47C 31/007* (2013.01); *A47C 31/02* (2013.01); *A47C 31/116* (2013.01)

(58) Field of Classification Search
CPC ..... A47C 7/021; A47C 7/0213; A47C 31/007; A47C 31/02; A47C 31/11; A47C 31/116
USPC ..... 297/228, 228.11, 228.12, 229
See application file for complete search history.

(56) References Cited

U.S. PATENT DOCUMENTS

D267,523 S * 1/1983 Neilson ..... 297/228.11
4,396,227 A * 8/1983 Neilson ..... B60N 2/609 297/228.11
4,518,198 A * 5/1985 Daniels ..... A45C 9/00 297/229 X
5,275,463 A * 1/1994 Rocha ..... A47C 31/11 297/228.12 X
5,893,184 A * 4/1999 Murphy ..... A47C 7/024 297/229 X
6,086,152 A * 7/2000 Zeller ..... A47C 1/143 297/228.12 X
6,491,996 B2 * 12/2002 Digangi ..... B32B 27/06 297/229 X
7,461,894 B2 * 12/2008 Leeds ..... A45C 3/00 297/229
7,621,010 B1 * 11/2009 Eltzroth ..... A61G 15/125 297/219.1
8,342,603 B2 * 1/2013 Leeds ..... G06Q 30/0226 297/229

(Continued)

*Primary Examiner* — Rodney B White

(74) *Attorney, Agent, or Firm* — Dunlap Bennett & Ludwig, PLLC; Brendan E. Squire

(57) ABSTRACT

A protective cover improves the hygiene of patient procedure chair/table, such as a toe cover. There is a need to for an improvement on the ability to effectively disinfect all components of a universally adaptable protective cover applied to the toe area of healthcare furnishing/patient procedure chair. The embodiments of the present protective cover is universally adaptable to various shapes and sizes found in patient procedure chairs. Textiles selected for use include vinyl, medical grade upholstery vinyl, or other textiles that may be used in healthcare settings so that all components can be disinfected with intermediate grade disinfectants. The design also allows for decoratively enhancing the patient environment. Dental patient chair will be used to demonstrate images. The design can be adapted to various patient chairs and tables.

13 Claims, 4 Drawing Sheets

(56) References Cited

U.S. PATENT DOCUMENTS

| | | | | |
|---|---|---|---|---|
| 8,403,412 | B2 * | 3/2013 | Leeds | A47C 31/11 297/219.1 |
| 8,414,071 | B2 * | 4/2013 | Rabson | A47C 31/113 297/228.12 |
| 8,733,836 | B2 * | 5/2014 | Gross | A47C 31/11 297/228.12 |
| 9,295,339 | B2 | 3/2016 | Hampton | |
| 9,387,357 | B2 | 7/2016 | Mueller | |
| 2007/0257533 | A1 * | 11/2007 | Resendez | B60N 2/6063 297/228.11 |
| 2009/0091165 | A1 * | 4/2009 | Thompson | B60N 2/6009 297/228.12 |
| 2009/0163336 | A1 | 6/2009 | Mueller | |
| 2010/0201169 | A1 | 8/2010 | Fox et al. | |
| 2011/0156459 | A1 * | 6/2011 | Leeds | G06Q 30/0635 297/229 |
| 2014/0049091 | A1 * | 2/2014 | Gross | A47C 7/22 297/452.63 |
| 2015/0015038 | A1 * | 1/2015 | Hampton | A47C 31/11 297/229 |
| 2016/0051097 | A1 * | 2/2016 | Farris, II | A47C 31/11 297/228.1 |
| 2016/0107552 | A1 * | 4/2016 | Wakeman | A47C 31/10 297/229 |

* cited by examiner

FIG. 1
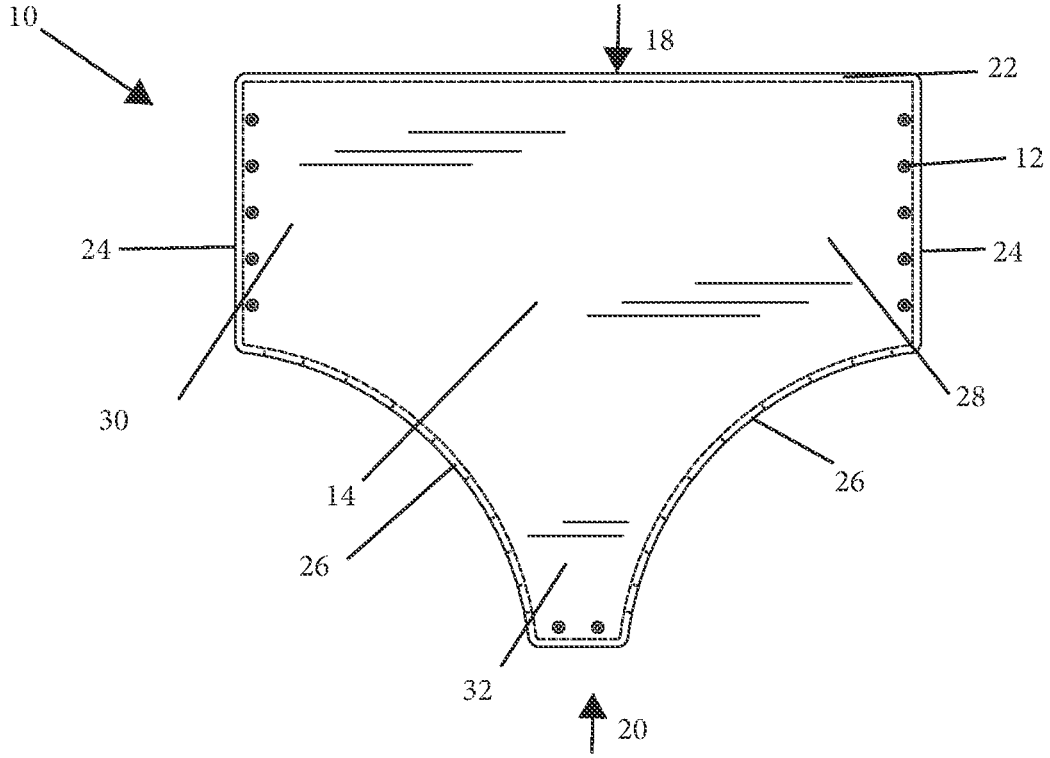
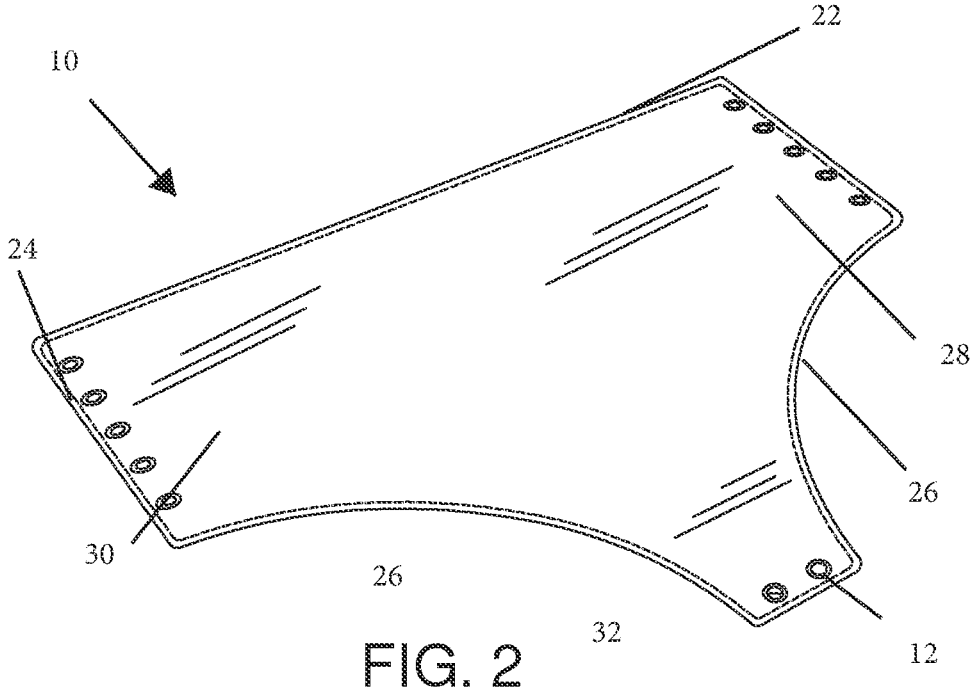
FIG. 2

PROTECTIVE PATIENT PROCEDURE CHAIR/TABLE TOE PROTECTIVE COVER WITH IMPROVED HYGIENIC AND ADAPTABLE DESIGN FOR MEDICAL TREATMENT FURNISHINGS

CROSS-REFERENCE TO RELATED APPLICATION

This application claims the benefit of priority of U.S. provisional application No. 62/939,230, filed Nov. 22, 2019, the contents of which are herein incorporated by reference.

BACKGROUND OF THE INVENTION

The present invention relates to medical treatment furnishings, and more particularly to covers for medical treatment furnishings.

Footwear inherently tracks in a multitude of microbes and debris, as well as posing a risk to damaging healthcare furniture upholstery. To the healthcare provider, infection control is paramount, in considering the patient's comfort the decorative aspect of the healthcare environment is important, as well as protecting the very expensive healthcare furniture from footwear damage.

When a patient is seated, there is an inherent risk for damage to the furniture due to footwear. To reposition themselves in a chair or table, a patient may dig their heels into the upholstery risking damage to the furniture upholstery. Also, at rest sometimes patients will bend their legs and place the soles of the shoes flat on the surface of a chair or exam table, therefore risking damage to the furniture upholstery and the transfer of microbes to the furnishing and protective covers.

Available protective covers which directly fasten to the healthcare furniture are made of a clear non-decorative vinyl (plastic) that must be purchased according to a furniture make and model, specifically cut to fit with complimentary fasteners allowing adaptation to the given healthcare furniture shape/size with corresponding positioned fasteners. Fastening and adapting to various shapes and sizes is typically achieved by a specifically cut vinyl in the form for a specific make and model chair/table, with specifically positioned loop and hook tape (Velcro), specifically positioned snaps, elastics, or woven fabric straps with fasteners.

Available products on the market are formed of clear non-decorative vinyl that have to be make/model specific. These have complimenting non-removable components attached to the frame of the furniture that cannot be adequately disinfected. Alternative options include varieties that use elastics or woven textile straps to adapt a cover to the healthcare furniture. Each may have adapting mechanisms that present inherent nooks and crannies that are reservoirs for hair, dust, debris and microbial contamination.

Many protective covers that have a complimentary component such as a hook and pile fasteners (Velcro) or snaps are that secured by male-female components. One part is attached to the frame of the chair/table with the second part secured to the cover material. Therefore the component parts attached to the frame are not removed and not readily accessible to healthcare staff for adequate cleaning and disinfecting during the entire lifetime of the furniture.

Likewise hook and pile tapes on self-adhering type Velcro is almost impossible to clean from dust, debris, and other contaminants. If the loop and hook tape adhesive smears it will serve as a culture medium for microbes and debris.

Products that use fabric straps/nylon straps, or elastic bands are not moisture resistant and have surface textures which inherently have nooks and crannies that are reservoirs for hair, dust, debris and microbes. Moreover, elastic straps have latex, and therefore present a risk of provoking latex allergy reactions.

As can be seen, there is a need to for an improvement on the ability to effectively disinfect all components of a universally adaptable protective cover used at the toe area to prevent footwear damage of healthcare furnishings.

SUMMARY OF THE INVENTION

In one aspect of the present invention, a protective cover for a toe of a medical furnishing is disclosed. The protective cover includes a cover formed of flexible medical grade furnishing fabric. The cover has a front side, a back side, a head end, and a toe end. A head edge of the cover extends laterally between opposed lateral side edges of the cover. The lateral side edges extend away from the head end towards the toe end for a length dimensioned to cover the toe end of the medical furnishing. An arcuate edge converges inwardly from the lateral side edges and terminates at the toe end of the cover. The arcuate edge defines a left side flap, a right-side flap, and a toe flap. A plurality of grommets is disposed in a spaced apart relation proximal to the lateral side edges of each of the left side flap, the right-side flap, and the toe flap. A flexible, non-porous cord is dimensioned to be laced between the plurality of grommets in each of the left side flap and the right-side flap to secure the protective cover to the toe end of the medical furnishing.

In some embodiments, the flexible medical grade furnishing fabric is a vinyl. Preferably, the vinyl has an antimicrobial and an antifungal property. The flexible medical grade furnishing fabric may include a plurality of layers joined along a peripheral edge of the cover. The plurality of layers may be joined by a stitch.

In some embodiments, the left side flap, and the right side flap are dimensioned to be formed around the lateral sides of the toe of medical furnishing. The toe flap is dimensioned to be formed around the toe end of the medical furnishing.

In some embodiments, the flexible, non-porous cord is a latex free material. Preferably, the flexible, non-porous cord is a Polyvinyl Chloride (PVC) cord.

In other aspects of the invention, a method of protecting a medical furnishing from contaminants is disclosed. The method includes placing a cover on a toe end of the medical furnishing. The cover being formed of flexible medical grade furnishing fabric, the cover having a front side, a back side, a head end, and a toe end. A the lateral side edge extends away from the head end towards the toe end for a length dimensioned to cover the toe end of the medical furnishing. An arcuate edge converges inwardly from the lateral side edge and terminates at the toe end of the cover. The arcuate edge defines a left side flap, a right side flap, and a toe flap. A plurality of grommets disposed in a spaced apart relation along each of the left side flap, the right-side flap, and the toe flap. The method includes the step of lacing a flexible, non-porous cord through the plurality of grommets from the head end to the toe end. The flexible, non-porous cord is then cinched to tighten the cover about the toe end of the medical furnishing. The flexible, non-porous cord is then secured against an outer face of the toe flap.

In some embodiments, the method includes wiping the cover with a disinfectant.

In other embodiments, the method includes loosening the flexible, non-porous cord, removing the flexible, non-porous cord from the plurality of grommets, and removing the cover from the medical furnishing.

In other embodiments, the method includes disinfecting each of the cover and the flexible, non-porous cord.

In yet other embodiments, the method includes reinstalling the cover to the medical furnishing.

These and other features, aspects and advantages of the present invention will become better understood with reference to the following drawings, description, and claims.

BRIEF DESCRIPTION OF THE DRAWINGS

FIG. 1 is a top plan view of a protective toe cover for a medical procedure chair;

FIG. 2 is a perspective view of a toe cover for a medical procedure chair;

DETAILED DESCRIPTION

Figure 3:
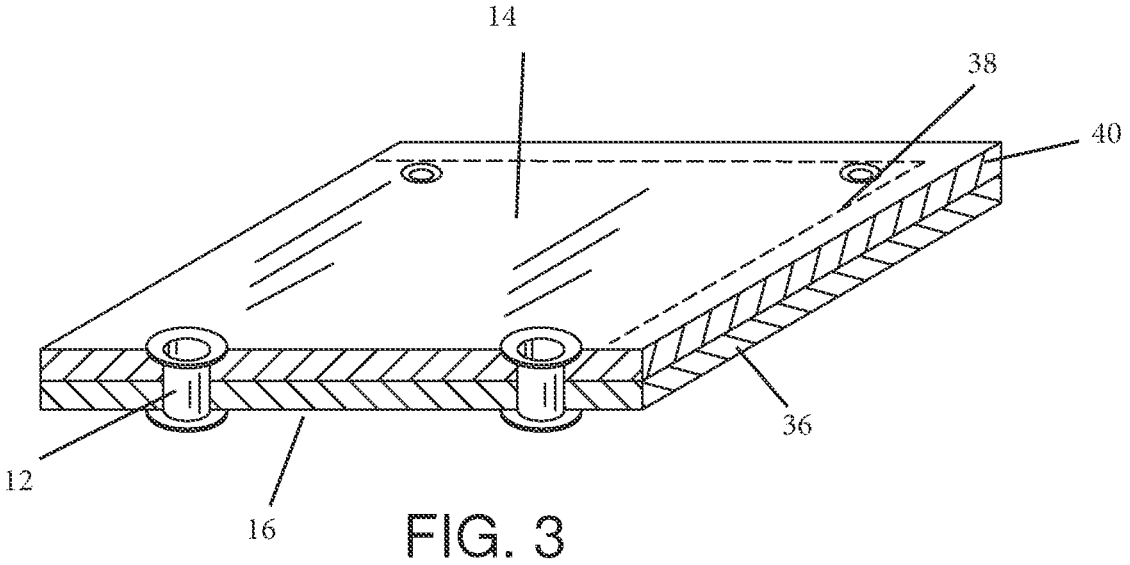
FIG. 3 is a layer diagram of a first embodiment of a toe cover shown with a stitch joining.

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides a system, method, and apparatus for facilitating effective disinfection of all components of a universally adaptable protective cover applied to the toe area of a healthcare furnishing. While the present disclosure will discuss application of the cover to a dental procedure furnishing 50, the protective cover 10 of the present invention may be applied to other medical procedure furnishings 50. By way of non-limiting example, the medical procedure furnishing 50 may also include surgical furnishings, examination tables, chemo-therapy chairs, dialysis furnishings, and a range of other medical procedure furnishings.

The universally adaptable protective cover 10 for a medical treatment furnishing 50 is designed to improve the hygienic disinfection of a patient procedure furnishing 50, such as a dental chair. In the non-limiting embodiment shown, the protective cover 10 is a toe cover for a dental procedure chair 50. As will be appreciated, the protective cover 10 is adaptable to other parts of a medical procedure furnishing 50, such as a head rest, and arm, or other component that requires disinfection between patient uses. The protective cover 10 and all of its adapting/fastening components and surfaces can be wiped down with an intermediate hospital level disinfectant.

The protective cover 10 is made of latex free textiles. A clear vinyl outer cover may overly a decorative layer, enhancing the appearance of the dental procedure furnishing 50 in the patient environment, and protecting the dental procedure furnishing 50 from footwear damage.

Textiles selected for use include vinyl, medical grade upholstery vinyl, or other medical grade textiles that may be used in healthcare settings according standards of the Chemical Fabrics and Film Association Inc. "Recommended Minimum Performance Standards for VINYL-COATED AND OTHER CHEMICAL COATED UPHOLSTERY FABRICS—HEALTHCARE", CFFA-HEALTHCARE-201, April 2020.

The textile may have incorporated antimicrobial, antifungal, and/or fire retardant treatments. Universal adaptability is achieved by using a flexible nonporous cord 34, such as a PVC cord, to lace and adapt the cover 10 to the dental procedure furnishing 50.

All surfaces and components are wipeable and can be disinfected with broad spectrum chemicals for surface disinfection, EPA intermediate level disinfectant, as per OSHA Blood Borne Pathogens Standard and CDC guidelines for nonporous surface disinfection. The entire unit is easily removed by a single healthcare staff member for disinfection of all components and easily reinstalled for continued use.

Footwear inherently tracks in a multitude of microbes and debris, as well as posing a risk to damaging healthcare furniture upholstery. To the healthcare provider, infection control is paramount. To ease the patient's anxiety during a medical visit, consideration of the patient's comfort and providing visually pleasing decorative aspects of the healthcare environment are important. For the healthcare provider, protecting their investment in very expensive healthcare furnishings, such as from footwear damage, is also very important.

As seen in reference to the drawings of FIGS. 1 and 2, a toe cover 10 includes a six sided flexible cover made with medical grade furnishing fabric, having a plurality of grommets 12 on three of the six sides disposed in a spaced apart relation along a lateral edge of the cover 10.

The cover 10 includes a front side 14, a back side 16, a head end 18, and a toe end 20. A head edge 22 of the cover 10 extends laterally between opposed lateral side edges 24 of the cover 10. The lateral side edges 24 extend away from the head end 18 towards the toe end 20 for a length dimensioned to cover the toe end of a medical furnishing.

An arcuate edge 26 converges inwardly from the lateral side edges 24 and terminates at the toe end 20 of the cover 10. The arcuate edge 26 defines a left side flap 28, a right side flap 30, and a toe flap 32, such that the left side flap 28 and the right side flap 30 can be formed around the lateral sides of the toe of the dental procedure chair 50 and the toe flap 32 can be formed around the toe end of the dental procedure chair 50.

The left side flap 28, the left side flap 30, and the toe flap 32 each have the grommets 12 that may be laced with a cord 34 to secure the cover 10 to the toe of the medical furnishing.

The cord 34 is a flexible, non-porous cord is having a smooth surface that is easily wiped with a surface disinfectant. The cord 34 is preferably a Latex Free material such as Polyvinyl Chloride (PVC) cord. The cord 34 allows the user to adjust the cover 10 as the cover 10 conforms to the furnishing 50 during an initial break in period without permitting the cover 10 to tear, as with fixed fastener covers, or a smearing, deterioration, or debonding of an adhesive due in adhesively mounted covers. In the dental context, typically due to the patient heel pressure on the cover 10 when adjusting their body in the furnishing for the procedure. The cord 34 may then be adjusted to further adapt the cover 10 to furnishing 50.

Ends of the PVC cord 34 may be secured with a knot, or a fastener 46, such as a two-hole cord stop, for universal adaptability. Larger or smaller versions can be adapted for specific needs, depending upon the dimensions of the medical procedure furnishing 50.

Figure 4:
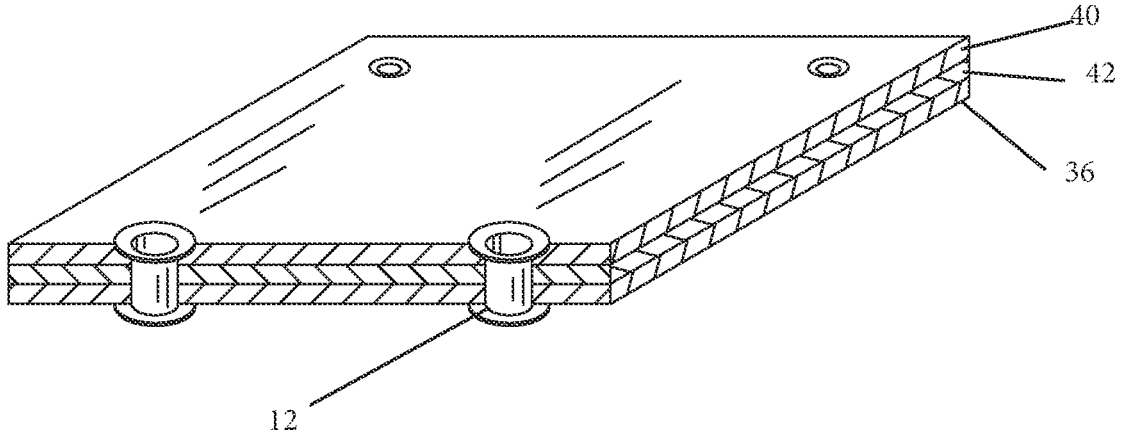
FIG. 4 is a layer diagram of a second embodiment of a toe cover shown with laminated layers.

Current upholstery vinyl typically has a fabric backing such as polyester, that is prone to the accumulation and retention of contaminants. Accordingly, as seen in reference to FIGS. 3 and 4, a moisture resistant backing 36 is joined to a back surface of the cover 10. The moisture resistant backing 36 may be joined with a stitch 38 along each of the six side edges so that the decorative and reverse sides are wipeable with a disinfectant and then can be wiped dry to re-install.

In an alternative embodiment, a decorative fabric 42 may be sandwiched between two layers of vinyl. The decorative side and reverse side utilize moisture resistant flexible plastic textiles for the healthcare setting and can be a single layer, or a plurality of layers which can laminated, heat welded, or sewn together along the side edges. If sewn, this minimizes patient contact with a seam to a single edge of the cover.

As will be appreciated from the present disclosure, the protective toe cover 10 is designed to facilitate the ability to effectively disinfect all components of the universally adaptable protective toe cover 10, such that the decorative front surface 14, the back surface 16, and adaptation components are wipeable for disinfection with broad spectrum chemicals as per OSHA Blood Borne Pathogens Standard and CDC guidelines for nonporous surface disinfection with EPA intermediate level disinfectant products. The decor is in the selected fabric design itself.

This improved patient procedure furnishing 50 protective toe cover 10; may include the following elements and features:

1) A six sided cover 10 with grommets 12 on three of the six sides for lacing with a flexible, non-porous cord 34 may be secured for universal adaptability to a toe of the medical furnishing 50. Larger or smaller versions can be adapted for specific needs. The decorative side and reverse side utilize moisture resistant textiles as a single layer or a plurality of which can be heat welded, laminated, or sewn together at all six edges. Designed so that all the surfaces and components are wipeable and can be disinfected with broad spectrum chemicals for surface disinfection with EPA intermediate level disinfectant, as per OSHA Blood Borne Pathogens Standard and CDC guidelines for nonporous surface disinfection. The decor is in the selected fabric design itself.

2) Ease of use. Can be placed, removed, and reinstalled back again by a single healthcare staff person with minimal effort. Easily laced, then slipped onto the medical furnishing 50, with adaptation of the cover 10 by tightening the flexible non-porous cord 34, and fastening of cord ends 34 with a fastener 46, such as a two-hole cord stopper, and then cutting off the excess cord length with scissors.

3) Textiles to be used are upholstery plastic textiles (vinyl) compatible for the healthcare setting. Vinyl textiles compatible for healthcare settings can tolerate the intermediate surface disinfectant chemicals used in healthcare settings such as hospitals, dental offices, and medical offices. Upholstery plastic (vinyl) for healthcare setting have incorporated one or more treatments to resist microbes.

4) Textile selection for fluid barrier textiles to be used on both the decorative surface and reverse surface. Variation in textile selections with specific treatments can vary based on specific healthcare setting requirements and applicable compliance requirements.

5) PVC cord is latex free. Increasing incidents of latex allergies have inspired a movement to latex free products in the healthcare setting. Elastics have latex.

In the embodiment shown for use as a toe cover 10 of a dental procedure chair 50 includes the plurality of grommets 12 disposed in a spaced apart relationship along three of the six sides, for fitting the protective cover 10 to a toe of the dental procedure chair 50. The flexible non-porous PVC cord 34 is laced through the plurality of grommets 12 and secured with a fastener 46 or a two-hole cord stop for universal adaptability.

The edge stitching 38 may include setting a gauge to allow for a ⅜-inch seam. The decorative panel 40, 42 and backing panel 36 are aligned with their surfaces together. Sewing is initiated ⅔ of the way down on the top edge of the part, with continued sewing around the outside, turning the part at the corners, to leave an opening between the beginning and end of the seam, that is large enough to allow for the part to be turned right side out. The corners may then be cut off, be careful not to cut the stitching. This will help the corners come together easier and allow for a more defined point at the corners.

Top stitching may be applied by tuning the part right side out. The gauge may then set to allow for a ¼-inch top stitch. Sewing is initiated slightly behind the opening, without a back tack. The seam may be kept inside and the material is kept flat while sewing. A back tack may be applied at the end.

The plurality of grommets 12 may then be applied by inserting a #1 size grommet 12 in each of a plurality of predrilled or punched hole locations in the cover 10.

In other embodiments, the protective layers 36, 40 may be laminated to encapsulate the decorative fabric layer 42. In some embodiments, the decorative fabric 42 may be sandwiched between the two layers of vinyl 36, 40 so that the decorative fabric 42 is protected from marring or receiving contaminants, while providing a surface that may cleaned with the intermediate level disinfectant.

The flexible non-porous cord 34 selected is a smooth surfaced material that reduces collection of contaminants and one that is easily wiped with surface disinfectant. Preferably, the cord 34 is made of a PVC latex free material.

Figure 5:
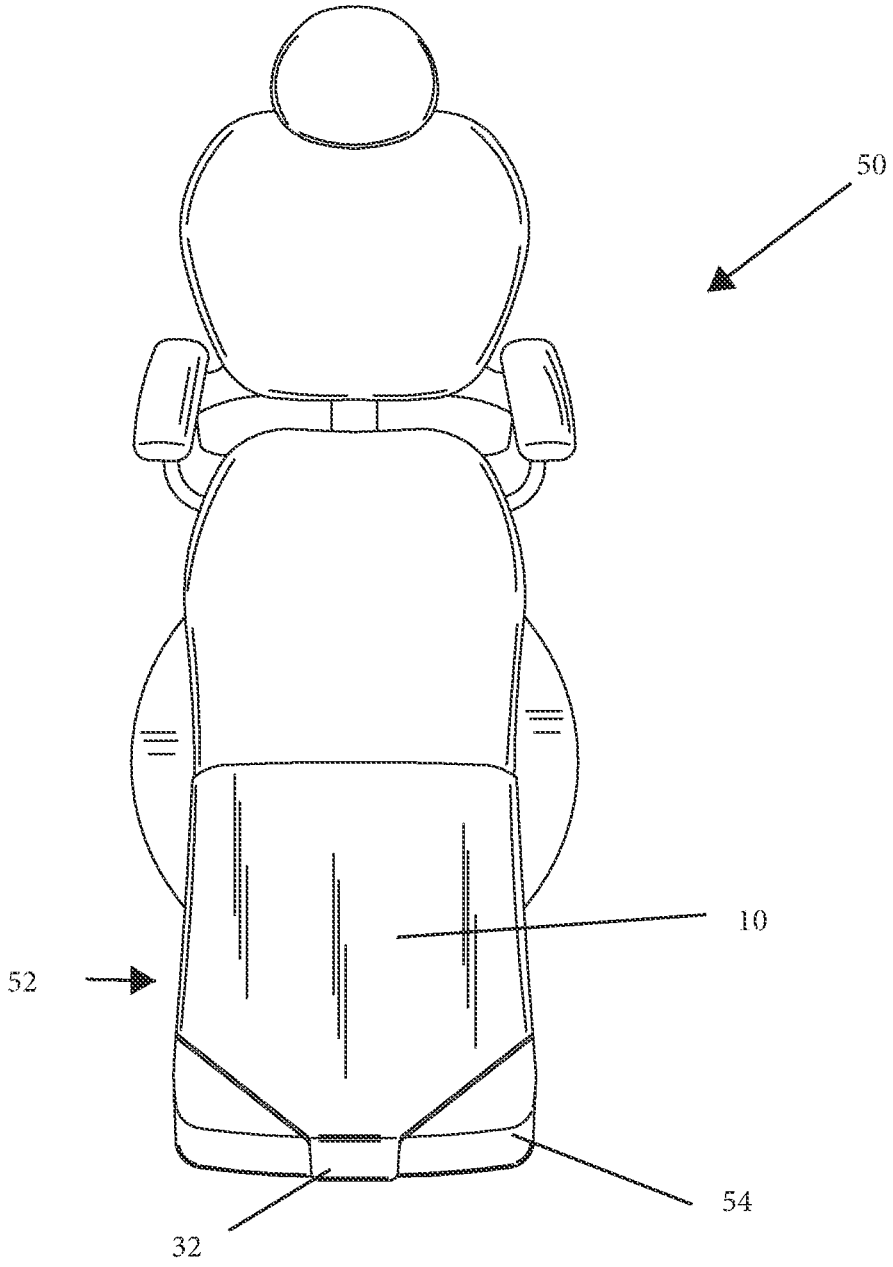
FIG. 5 is a front perspective view of a dental procedure chair with a protective toe cover laid flat for installation on the dental procedure chair.
Figure 6:
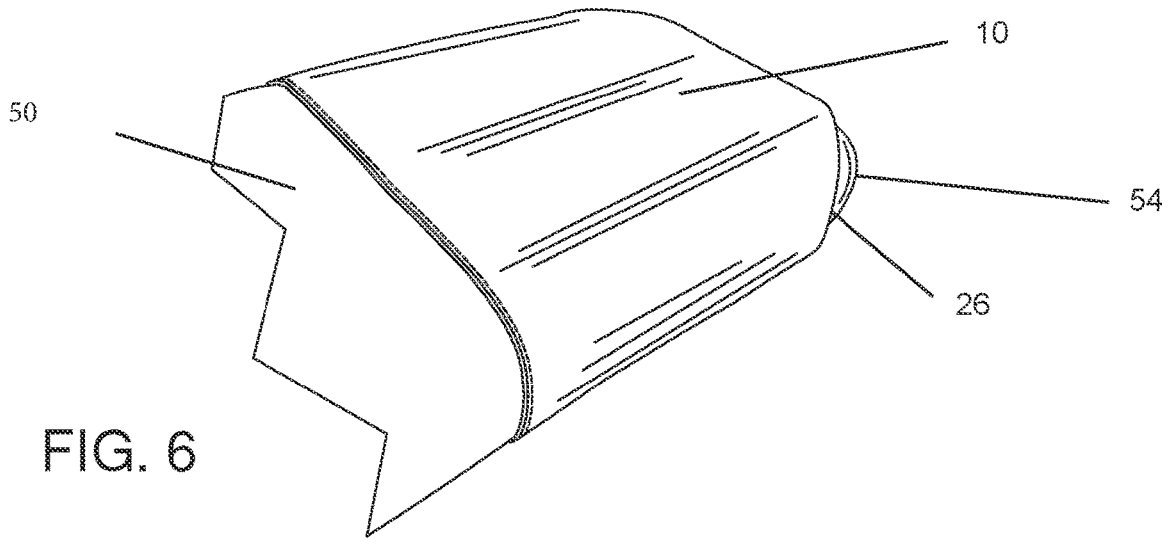
FIG. 6 is a side view of the protective toe cover applied to a toe end of the dental procedure chair.
Figure 7:
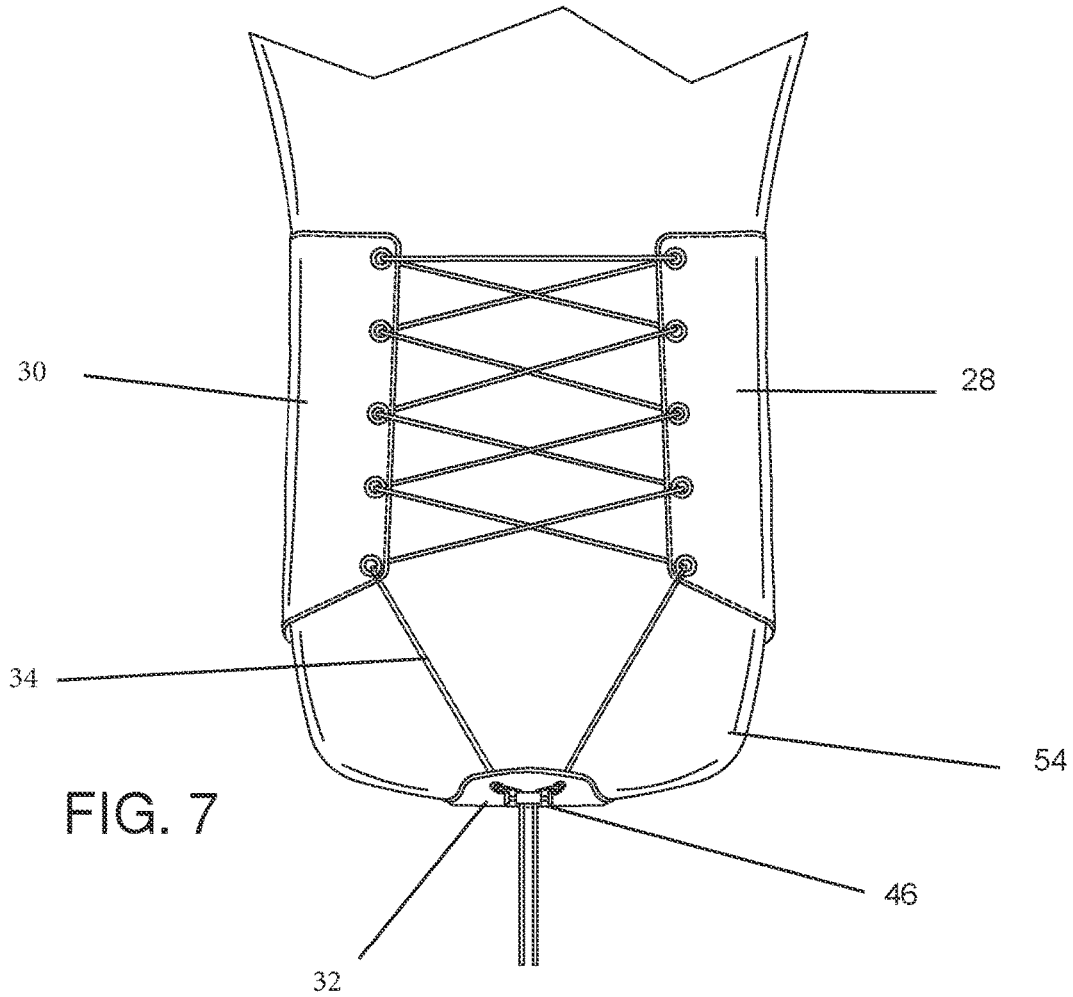
FIG. 7 is a bottom plan view of a toe cover securement to the dental procedure chair.

As seen in reference to FIGS. 5-7, the toe cover 10 of the present invention is applied to the toe end 52 of the medical procedure furnishing 50. The toe cover 10 is laid out flat on the toe end 52 of the medical procedure furnishing 50 so that the left side flap 28, the right side flap 30, and the toe flap 32 are oriented relative to the corresponding sides of the medical procedure furnishing 50.

The cord 34 is laced through the plurality of grommets 12 along opposing left side flap 28 and right side flap 30 starting at the head end 18 of the cover 10 to a toe end 20 of the cover 10. The cord 34 may then be laced from a last grommet 12 of the left side flap 28 and the right side flap 30 and then laced through the plurality of grommets 12 in the toe flap 32. To provide a better fit of the cover 10 to the medical procedure furnishing 50, the cord 34 is routed and laced to a toe flap grommet 12 disposed on the same side as the last grommet 12 of each of the left side flap 28 and the right side flap 30. More preferably the cord 34 is laced from the back surface of the cover 10 to terminate on at the front surface 14 of the cover.

The cover 10 is then adjusted so that the arcuate edge 26 is positioned proximal to the corners 54 at the toe end 52 of the medical procedure furnishing 50. The cord 34 is then drawn tightly to draw the lacing secure the cover 10 about the medical procedure furnishing 50. The cord 34 may then be tied with a knot, more preferably with the cinch fastener 46, to secure the cord 34 and the cover 10 in position on the medical procedure furnishing 50.

It should be understood, of course, that the foregoing relates to exemplary embodiments of the invention and that modifications may be made without departing from the spirit and scope of the invention as set forth in the following claims.

What is claimed is:

1. A protective covering for a toe end of a medical furnishing, comprising:

a cover formed of a flexible medical grade furnishing fabric, the cover having a front side, a back side, a head end, and a toe end, a head edge of the cover extends laterally between opposed lateral side edges of the cover, the opposed lateral side edges extend away from the head end towards the toe end for a length dimensioned to cover the toe end of the medical furnishing;

an arcuate edge converges inwardly from the opposed lateral side edges and terminates at the toe end of the cover, the arcuate edge defines a left side flap, a right-side flap, and a toe flap, a plurality of grommets disposed in a spaced apart relation proximal to the opposed lateral side edges of each of the left side flap, the right-side flap, and the toe flap; and a flexible, non-porous cord dimensioned to be laterally laced between the plurality of grommets in each of the left side flap, the right-side flap, and to extend to and be laced in the grommets of the toe flap, the cord configured to draw the left-side flap, the right-side flap, and toe flap towards one another via the plurality of grommets in the left-side flap, the right-side flap, and the toe flap to secure the protective covering to the toe end of the medical furnishing.

2. The protective covering of claim 1, wherein the flexible medical grade furnishing fabric is a vinyl.

3. The protective covering of claim 2, wherein the vinyl has an antimicrobial and an antifungal property.

4. The protective covering of claim 3, wherein the flexible medical grade furnishing fabric comprises a plurality of layers joined along a peripheral edge of the cover.

5. The protective covering of claim 4, wherein the plurality of layers is joined by a stitch.

6. The protective covering of claim 4, wherein the left side flap, and the right side flap are dimensioned to be formed around the opposed lateral sides of the toe end of the medical furnishing, and the toe flap is dimensioned to be formed around the toe end of the medical furnishing.

7. The protective covering of claim 1, wherein the flexible, non-porous cord is a latex free material.

8. The protective covering of claim 7, wherein the flexible, non-porous cord is a Polyvinyl Chloride (PVC) cord.

9. A method of protecting a medical furnishing from contaminants, comprising:

placing a cover on a toe end of the medical furnishing, the cover formed of a flexible medical grade furnishing fabric, the cover having a front side, a back side, a head end, and a toe end, a lateral side edge extends away from the head end towards the toe end for a length dimensioned to cover the toe end of the medical furnishing, an arcuate edge converges inwardly from the lateral side edge and terminates at the toe end of the cover, the arcuate edge defines a left side flap, a right side flap, and a toe flap, a plurality of grommets disposed in a spaced apart relation along each of the left side flap, the right side flap, and the toe flap;

lacing a flexible, non-porous cord through the plurality of grommets in the left side flap and the right side flap from the head end to the toe end;

lacing the flexible, non-porous cord through the plurality of grommets in the toe flap;

cinching the flexible, non-porous cord to draw the left-side flap, the right-side flap, and toe flap towards one another via the plurality of grommets in the left-side flap, the right-side flap, and the toe flap to tighten the cover about the toe end of the medical furnishing; and securing the flexible, non-porous cord against an outer face of the toe flap.

10. The method of claim 9, further comprising:

wiping the cover with a disinfectant.

11. The method of claim 9, further comprising:

loosening the flexible, non-porous cord;

removing the flexible, non-porous cord from the plurality of grommets; and removing the cover from the medical furnishing.

12. The method of claim 11, further comprising:

disinfecting each of the cover and the flexible, non-porous cord.

13. The method of claim 12, further comprising:

reinstalling the cover to the medical furnishing.

* * * * *